US005215334A

United States Patent [19]

Presson et al.

[11] Patent Number: 5,215,334

[45] Date of Patent: Jun. 1, 1993

[54] EMERGENCY MEDICAL CARD

[76] Inventors: Ronald C. Presson, 202 N. Bluff Rd., Collinsville, Ill. 62234; Ralph Eskew, 714 Gravois Rd., Fenton, Mo. 63026; Christina Charpentier, 5817 Cataumet Ct., St. Louis, Mo. 63128

[21] Appl. No.: 919,135

[22] Filed: Jul. 23, 1992

[51] Int. Cl.[5] ..... B42D 15/00

[52] U.S. Cl. ..... 283/76; 283/100; 283/105; 283/904

[58] Field of Search ..... 283/76, 904, 100, 105

[56] References Cited

U.S. PATENT DOCUMENTS

| | | | |
|---|---|---|---|
| 3,117,608 | 1/1964 | Goss et al. | 283/76 X |
| 4,141,400 | 2/1979 | Mangan | 283/904 X |
| 4,197,665 | 4/1980 | Siiter | 283/76 X |
| 4,249,330 | 2/1981 | Chioffe | 283/76 X |
| 4,318,554 | 3/1982 | Anderson et al. | 283/76 |
| 4,435,912 | 3/1984 | Adrian et al. | 283/76 |
| 4,632,428 | 12/1986 | Brown | 283/76 |
| 5,092,018 | 3/1992 | Seron | 283/904 X |

*Primary Examiner*—Paul A. Bell

*Attorney, Agent, or Firm*—Rogers, Howell & Haferkamp

[57] ABSTRACT

An emergency medical card includes a first location for displaying a reduced-sized medical data transparency with a detachable lens element for separation from the card to view the medical data contained on the transparency. In a first embodiment, the hinge member secures the periphery of a first card with the periphery of a reduced-size lens card, with the hinge permitting the lens card to be bent back adjacent to the first card so that its profile remains that of a typical credit card. In a second embodiment, the lens is secured by a perforation within the profile of the same card.

11 Claims, 1 Drawing Sheet

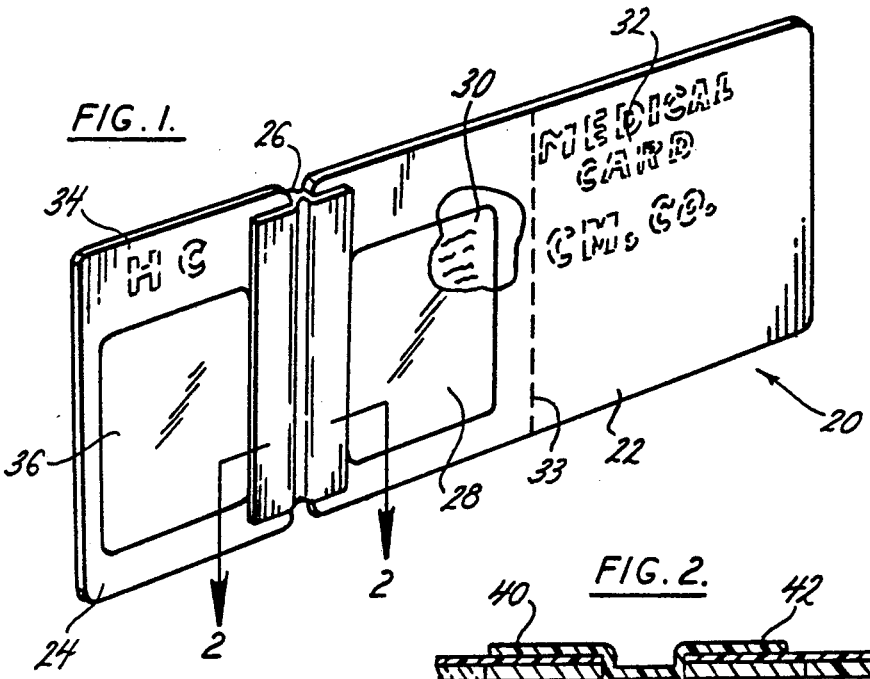
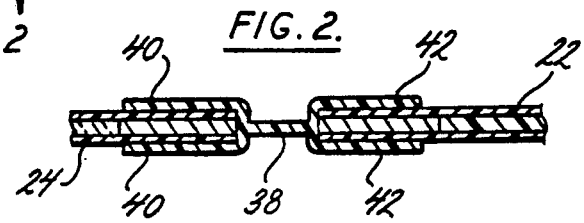
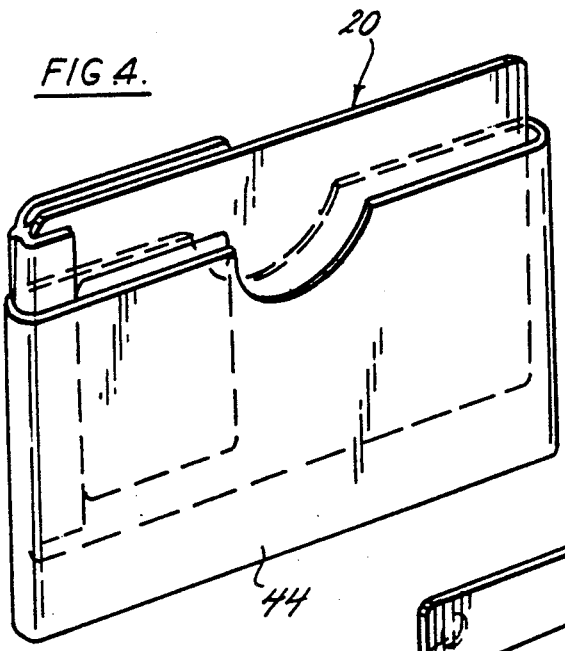
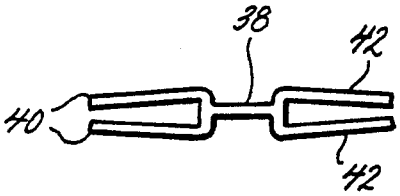
FIG. 3.
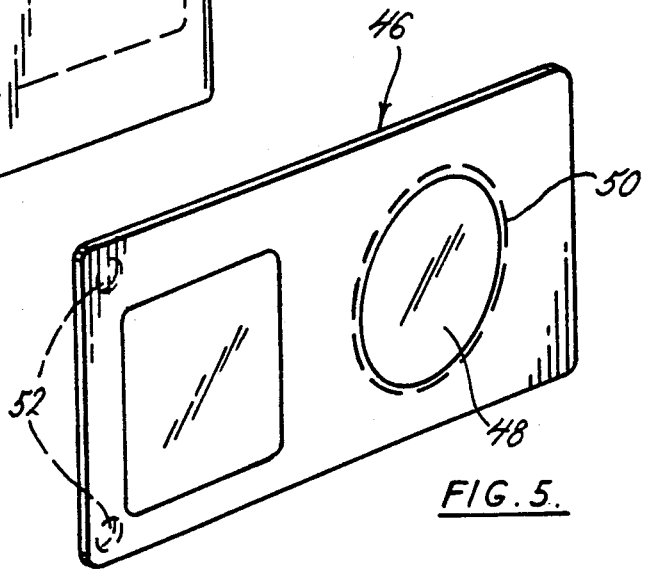
FIG. 5.

EMERGENCY MEDICAL CARD

BACKGROUND AND SUMMARY OF THE INVENTION

Various kinds of approaches have been taken in the prior art for recording medical information in a format suitable for use in an emergency situation. One approach is to provide a medical data card for manually recording the data which a user may simply carry in his wallet. Unfortunately, these cards do not provide enough space for recording all of the pertinent information which, in some cases, is critical in administering proper medical attention in an emergency situation. Therefore, it is desirable to provide the medical data in a reduced format in order to include everything that could be used in such a situation. However, when this information is contained in a reduced format, its readability is potentially compromised for various reasons. The first of these is that special care must be taken in recording and preserving the information in the card format as the card is subject to wear, heat, moisture, and other conditions which tend to impair the readability of the recorded information. Still another problem relates to the need to quickly be able to read the information without requiring additional specialized equipment. If a user is in a car accident, for example, the emergency medical personnel who arrive on the scene typically do not have any special equipment for reading reduced-sized medical information. This is perhaps because there are many various kinds of data cards which would require a myriad of equipment to be carried.

In order to solve these and other problems in the prior art, the inventors herein have succeeded in designing and developing an emergency medical card which has a laminated "window" for carrying microprocessed data, and a detachable lens which may be conveniently separated from the card and used by emergency medical personnel quickly and conveniently to read the medical data. Thus, a user need not rely on emergency medical personnel having access to any specialized equipment, card readers, magnifying lenses, or the like and instead can be confident in knowing that the medical data may be readily accessed by anyone. The emergency medical card may be provided in either of two embodiments. In a first embodiment, a poly hinge having a pair of opposing, flexible clamps secures a separate lens "mini-card" to a peripheral edge of a credit card-sized data card which carries the medical information. The poly hinge is sufficiently flexible to permit the lens card portion to be folded completely around and adjacent the data card portion so that the medical card may be conveniently carried in any credit card-sized opening in a wallet, purse, or the like. Also, a card carrier may be provided into which the emergency medical card may be slipped with the lens card folded over, and the carrying case retained as a unit. The opposing clamps have sufficient resiliency to "clamp" along the edge of the card and lens and hold them together for storage and carrying. When the need arises, either side of the hinge may be released by simply sliding the lens card transversely to the data card such that either one of the two slides out from within the opposing clamps. The lens card may be then oriented at a convenient focal point for viewing the reduced-size medical information carried in the data card.

In still another embodiment, the lens may be mounted directly within the contour, or periphery, of the data card. The lens may be conveniently mounted with a perforated "hinge" which permits a user to permanently separate the lens from the data card for viewing the medical information. Alternately, a multiple use "hinge" arrangement may be utilized such that the lens may be replaced for reuse.

In either embodiment of the invention, holes may be provided in the card to permit the card to be worn or secured to the user, such as through a key ring, shoelace, necklace, etc. To enhance this "wearable" feature, the "hinged" embodiment may have a reduced size card, smaller than a credit card, for carrying the medical data. Also, in either embodiment, the medical information may be microprocessed for imaging at approximately three times standard microfilm size. With this microprocessing, an observer's unaided eye may discern that information of some type is printed and available, but requires magnification for clear reading. This is readily recognizable by an emergency medical person and desirably alerts them to the presence of the information, and its location. The almost discernible information also encourages trained personnel to take the next step and detach the lens for viewing of the information. If smaller type or reproductions of the data were used, medical personnel may incorrectly assume that the information is not readily accessible and hence not bother trying to "figure out" what is required to read the information.

While the principal advantages and features of the present invention have been described above, a more complete and thorough understanding of the invention may be attained by referring to the drawings and description of the preferred embodiment which follow.

BRIEF DESCRIPTION OF THE DRAWINGS

FIG. 1 is a perspective view of the first embodiment of the emergency medical card with the lens card attached with a detachable hinge;

FIG. 2 is a partial cross-sectional view taken along the plane of line 2—2 in FIG. 1 and detailing the hinge;

FIG. 3 is a top view of the hinge;

FIG. 4 is a perspective view of the emergency medical card of the first embodiment arranged in a carrying case; and FIG. 5 is a perspective view of a second embodiment of the emergency medical card of the present invention.

DETAILED DESCRIPTION OF THE PREFERRED EMBODIMENT

As shown in FIGS. 1–4, the emergency medical card has as its first embodiment 20 a laminated credit card-sized data card 22, a lens card 24, and a detachable hinge 26 for securing the two together. The data card 22 has a generally transparent area 28 within which may be secured a medical data transparency 30 having microprocessed medical data thereon to provide personal data and a medical profile of the user of the card 20. This information may be laminated in place on the data card 22 which also includes a suitable area 32 for the placement of advertising or the like. Alternately, in a "wearable card" embodiment, the data card 22 may be of a reduced size such as that defined by line 33, and be provided with the holes 52 as shown in FIG. 5. This reduced size data card would enhance its being conveniently worn instead of being carried like a credit card. The lens card 24 includes a peripheral border area 34 for grasping of the lens card 24, and a lens member 36 which is suitably configured to view the medical data. The detachable hinge 26, as best shown in FIGS. 2 and 3, includes a center element 38 which joins two pairs of flexible clamps 40, 42. These clamp pairs 40, 42 are formed such that in their unstressed orientation, the outer ends thereof are closer together than the inner ends thereof, as shown in FIG. 3. Thus, as the data card 22 or lens card 24 are slipped therebetween, the pressure exerted by clamp pairs 40, 42 secures them in a detachable manner. For dataching, the card members 22, 24 may be moved transversely to the hinge 26 such that one or the other, or both, of card members 22, 24 slide out from within clamp pairs 40, 42.

As shown in FIG. 4, a carrying case 44 is sized to closely contain and confine the first embodiment 20 with the lens card 24 folded back adjacent to the data card 22. In this configuration, the entire first embodiment 20 is thus reduced in size to virtually a standard credit card so that it may be conveniently stored by a user in a wallet or purse.

As shown in FIG. 5, a second embodiment 46 includes a detachable lens 48 surrounded by a series of perforations 50, or the like. Various perforations 50 may be used, all as well known in the art, to either provide for a one-time, irreversible, removal of lens 48 from card 46. Alternately, a reusable perforation 50 may be provided, or some other hinge design as known in the art, to permit the lens 48 to be removed and replaced within card 46. A second additional feature shown in FIG. 5 includes a pair of holes 52 which may be provided in either the first embodiment 20 or second embodiment 46, as desired. These holes 52 permit the card to be secured to a key ring, key chain, bracelet, necklace, shoelace, etc. for carrying the card by an individual.

There are various changes and modifications which may be made to the invention as would be apparent to those skilled in the art. However, these changes or modifications are included in the teaching of the disclosure, and it is intended that the invention be limited only by the scope of the claims appended hereto.

We claim:

1. An emergency medical card, said emergency medical card having recorded thereon emergency medical information in reduced size for viewing through a magnifying means, and said emergency medical card having a detachable lens means secured within the periphery of said emergency medical card along a perforation line so that when it is desired to read said emergency medical information said lens means may be conveniently detached from said emergency medical card about said perforation line and used to view said emergency medical information.

2. An emergency medical card, said emergency medical card having recorded thereon emergency medical information in reduced size for viewing through a magnifying means, and said emergency medical card having a detachable lens means attached to said emergency medical card along a peripheral edge thereof with a hinge means so that when it is desired to read said emergency medical information said lens means may be conveniently detached from said emergency medical card and used to view said emergency medical information and said detachable lens means may be readily reattached to said emergency medical card after detachment therefrom to facilitate its re-use, said hinge means being sufficiently flexible to permit said lens means to be doubled over flat against said emergency medical card so that said emergency medical card may be conveniently stored in a wallet or the like and wherein said hinge means may itself be conveniently attached and detached from either of said emergency medical card or said lens means.

3. The emergency medical card of claim 2 wherein said hinge means includes at least one pair of flexible clamps for attaching to one of said emergency medical card or said lens means, said flexible clamps being adapted to slide onto and off of said one of said emergency medical card or said lens means.

4. The emergency medical card of claim 3 wherein said hinge means includes two pairs of said flexible clamps, one pair being adapted for attachment to said emergency medical card and the other pair being adapted for attachment to said lens.

5. The emergency medical card of claim 4 wherein said emergency medical card is approximately the size of a credit card.

6. The emergency medical card of claim 5 further comprising a credit card-sized carrying case, said emergency medical card being adapted for insertion into and storage in said carrying case.

7. The emergency medical card of claim 2 further comprising at least one hole therethrough to facilitate its attachment to a user by means of a shoestring or the like.

8. An emergency medical card, said emergency medical card having recorded thereon emergency medical information in reduced size for viewing through a magnifying means, a magnifying lens means, and a detachable hinge means for securing said magnifying lens means to said emergency medical card, said detachable hinge means including a pair of flexible clamps for attaching to said magnifying lens means and said emergency medical card.

9. The emergency medical card of claim 8 wherein said detachable hinge means is sufficiently flexible to permit said magnifying lens means to be folded over flat against said emergency medical card for storage.

10. The emergency medical card of claim 9 wherein said lens means is itself mounted on a reduced size card.

11. The emergency medical card of claim 10 wherein said emergency medical card is approximately the size of a credit card.

* * * * *